US006299687B1

(12) United States Patent
Inaba et al.

(10) Patent No.: US 6,299,687 B1
(45) Date of Patent: Oct. 9, 2001

(54) PAINT MASK APPARATUS

(75) Inventors: Keiichi Inaba; Kiyoshi Yazaki, both of Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 09/631,956

(22) Filed: Aug. 3, 2000

(30) Foreign Application Priority Data

Aug. 9, 1999 (JP) ..... 11-224879

(51) Int. Cl.[7] ..... B05B 15/04
(52) U.S. Cl. ..... 118/301; 428/99
(58) Field of Search ..... 428/99; 118/301

(56) References Cited

U.S. PATENT DOCUMENTS 5,985,465 11/1999 Daichou et al. ..... 428/458
6,135,050 10/2000 Inaba et al. ..... 118/301

FOREIGN PATENT DOCUMENTS 4-322760 11/1992 (JP) ..... B05B/15/04
4-338252 11/1992 (JP) ..... B05B/15/04

*Primary Examiner*—Alexander S. Thomas
(74) *Attorney, Agent, or Firm*—Sughrue, Mion, Zinn, Macpeak & Seas, PLLC

(57) ABSTRACT

A paint mask apparatus capable of accommodating different types of parts to be painted by constructing a mask body and a receiving jig so as to both be detachable with respect to the apparatus main body. A paint mask apparatus has a receiving jig for mounting a part to be painted supported by a jig base provided on an outer base, and a mask supporting frame with an integrated mask body of a predetermined shape which covers at least the peripheral edge portion of an area to be painted of a part to be painted attached to the outer base so as to be able to swing up and down such that the mask body can both cover and uncover the receiving jig from above. By constructing the mask body so as to be detachable from the mask supporting frame and constructing the receiving jig so as to be detachable from the jig base and only replacing the mask body and the receiving jig, the paint mask apparatus can be used for painting a different type of part to be painted without replacing the base and the jig base.

10 Claims, 9 Drawing Sheets

PAINT MASK APPARATUS

FIELD OF THE INVENTION

The present invention relates to a paint mask apparatus used to apply a paint treatment to only a required area of a molded component, such as a lens or a lamp body, which forms a component part of a vehicular lamp, for example.

BACKGROUND OF THE INVENTION

A conventional paint mask apparatus of the same general type as that to which the invention relates, as shown in FIG. 15, is constructed with a receiving jig 3 for mounting a part to be painted supported by a jig base 2 provided in a base 1, while a mask supporting frame 5 with an integrated mask main body 6 shaped so that it corresponds to the part 7 is attached to the base 1 so as to be able to swing up and down, such that the mask main body 6 can both cover (as indicated by broken lines in FIG. 15) and uncover (as indicated by solid lines in FIG. 15) the receiving jig 3 (the part 7) from above.

Reference numeral 4 denotes a link mechanism that raises and lowers the jig base 2, and reference numeral 4*a* denotes a lever for raising and lowering the link mechanism 4 such that, by raising the receiving jig 3 with respect to the mask main body 6, the part 7 becomes covered in the correct position with respect to the mask main body 6.

An opening 6*a* corresponding to the area to be painted of the 7 is formed in the mask main body 6. Spray paint is applied from above the mask main body 6 with a spray gun 8 when the part 7 is covered by the mask main body 6 so as to paint only the desired area to be painted thereof.

However, with the aforementioned conventional paint mask apparatus, a different paint mask apparatus must be provided for each different type of part to be painted. That is, if the parts 7 differ, an entire paint mask apparatus including not only the mask main body 6 and the receiving jig 3 which are directly related to the shape of the part 7, but also the base 1 and the jig base 2 must be made to match the part 7, which is extremely costly.

Also, when this type of paint mask apparatus is incorporated into a general production line and the type of parts to be painted is to be changed, the entire paint mask apparatus must be replaced, which involves removing the apparatus from the line and installing another in its place, which is an extremely bothersome operation.

Additionally a large space is required for storing the paint mask apparatus that was removed from the line.

SUMMARY OF THE INVENTION

In view of the foregoing problems, it is an object of the present invention to provide a paint mask apparatus which is easily able to accommodate different types of parts to be painted by constructing both the mask body and the receiving jig so as to be detachable.

In order to achieve the foregoing and other objects of the invention, in a paint mask apparatus in which a receiving jig for mounting a part to be painted is supported by a jig base provided in an outer base and a mask supporting frame with an integrated mask main body of a shape which corresponds to the part to be painted is attached to the outer base so as to be able to swing up and down such that the maskmain body can cover and uncover the receiving jig from above, the mask supporting frame is constructed so as to be detachable from the outer base and the receiving jig is constructed so as to be detachable from the jig base.

When it is desired that paint be applied to different types of parts to be painted, a mask supporting frame with an integrated mask main body corresponding to the new part to be painted and a receiving jig also corresponding to the new part to be painted are made. The mask supporting frame and the receiving jig integrated with the paint mask apparatus are both removed and a mask supporting frame with an integrated mask main body and a receiving jig both corresponding to the new part to be painted are attached, thereby enabling the paint mask apparatus to be used for painting different types of parts to be painted.

Even if the paint mask apparatus is incorporated into a production line, only the mask supporting frame and receiving jig need to be replaced, which is a simple operation that can be done in a short period of time.

Further, the removed mask supporting frame and receiving jig are not as bulky compared to the overall paint mask apparatus. Therefore, only a small amount of storage space is needed compared to when storing a complete paint mask apparatus.

A detachable portion between the mask body and the mask supporting frame may be formed with a dovetail groove slide-engaging portion extending along the extended side of the mask supporting frame, and a detachable portion between the receiving jig and the jig base is formed by a slide-engaging portion extending along the top surface of the jig base. With this arrangement, the mask body can be detached from the mask supporting frame by sliding it along the dovetail groove slide-engaging portion. The receiving jig can be detached from the jig base by sliding it along the slide-engaging portion.

The mask supporting frame may be formed so as to swing around a horizontal axis by operating a fluid cylinder mechanism for opening and closing the mask supporting frame and which is disposed between the mask supporting frame and the outer base. The jig base is formed so as to be vertically raised and lowered by operating a fluid cylinder mechanism for raising and lowering the jig base, which mechanism is disposed between the jig base and the base. The mask supporting frame is swung (open and closed) by operating the fluid cylinder mechanism for opening and closing the mask supporting frame, and the jig base is raised and lowered by operating the fluid cylinder mechanism for raising and lowering the jig base.

The dovetail groove slide-engaging portion between the mask body and the mask supporting frame may be formed so as to extend from the swinging tip portion side of the mask supporting frame to the base end portion side. The slide-engaging portion between the receiving jig and the jig base is formed so as to extend in the front/rear direction of the jig base and the mask supporting frame is formed so as to swing according to the pair of fluid cylinder mechanisms for opening and closing the mask supporting frame provided opposite the left and right side edge portions of the mask supporting frame. In this case, the mask body can be attached to the mask supporting frame by sliding it to the rear along the dovetail groove slide-engaging portion from the front side (the opening and closing side of the mask supporting frame) of the apparatus main body. The mask body can be separated from the mask supporting frame by sliding it to the front along the dovetail groove slide-engaging portion. Also, when the mask supporting frame is in a sprung-up state, the receiving jig can be attached to or detached from the jig base of the receiving jig by sliding it vertically and forward/backward on the slide-engaging portion of the jig base.

The cylinder mechanisms for opening and closing the mask supporting frame that swings the mask supporting frame is provided on the left and right side portions of the mask supporting frame so as not to hinder attaching and detaching operations of the receiving jig.

A mask main body of a predetermined shape covering the peripheral edge portion of the area to be painted of the part to be painted may be integrally attached with the mask body so as to be detachable. In such a case, when it is desired that paint be applied to different types of parts to be painted, if only the mask body and the receiving jig need to be replaced, a mask main body corresponding to the new part to be painted and a receiving jig also corresponding to the new part to be painted are made. The mask main body is removed from the mask body and the receiving jig is removed from the jig base, and a mask main body corresponding to the new part to be painted is attached to the mask body and a receiving jig corresponding to the new part to be painted is attached to the jig base, thereby enabling the paint mask apparatus to be used for painting different types of parts to be painted.

The replacement operation of the mask body and receiving jig when the paint mask apparatus is incorporated into a production line are simple and can be done in a short period of time.

Moreover, the removed mask main body is not bulky compared with the entire mask body. Accordingly, the storage space can be equivalently smaller.

The fluid cylinder mechanisms can be either air cylinder mechanisms or hydraulic cylinder mechanisms.

DESCRIPTION OF THE PREFERRED EMBODIMENTS

The present invention now will be described with reference to the following preferred embodiments.

Figure 1:
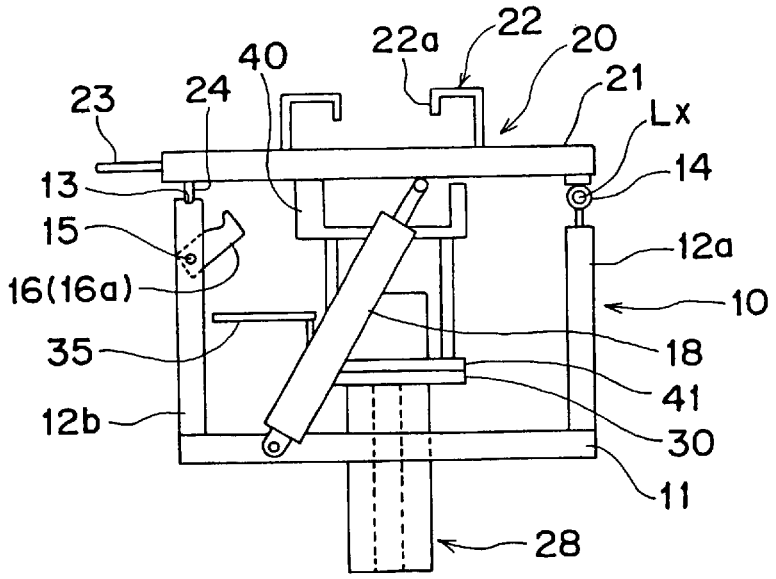
FIG. 1 is a diagram of the of a paint mask apparatus constructed according to one embodiment of the present invention.
Figure 2:
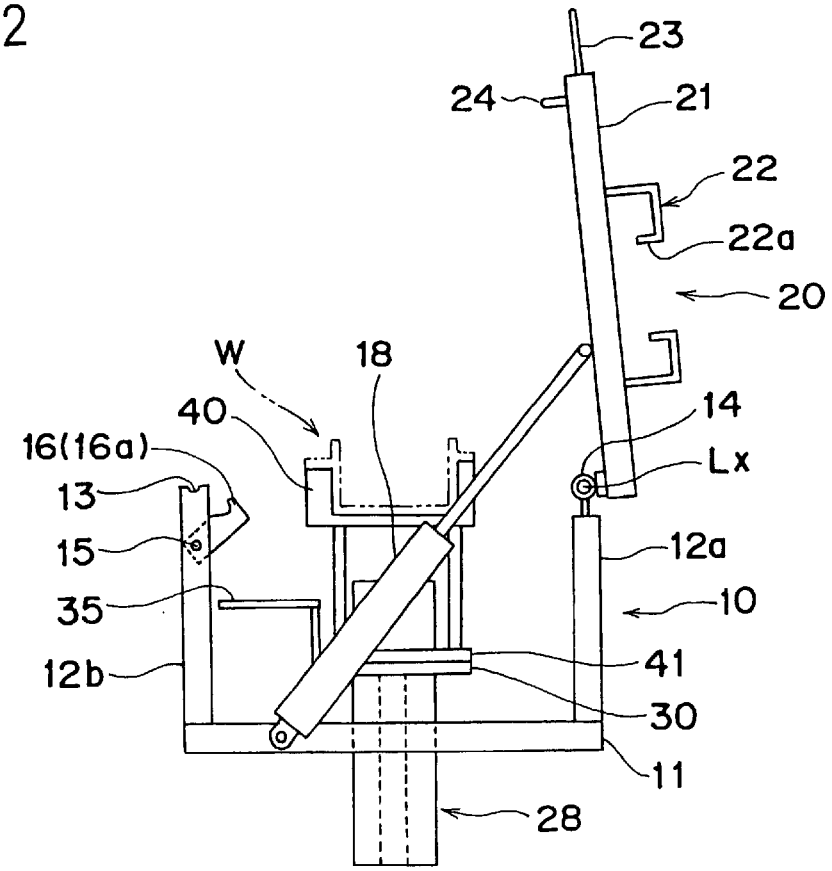
FIG. 2 is a diagram of the same apparatus as in FIG. 1 in which the area above the receiving jig is open.
Figure 3:
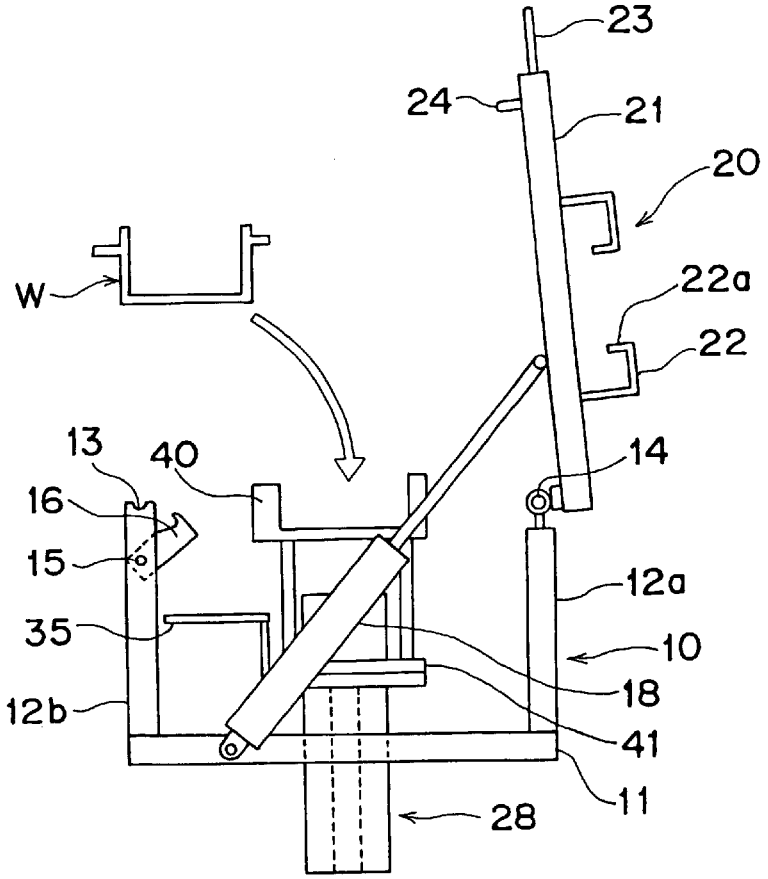
FIG. 3 is diagram of the same entire apparatus showing the work being set in the receiving jig.
Figure 4:
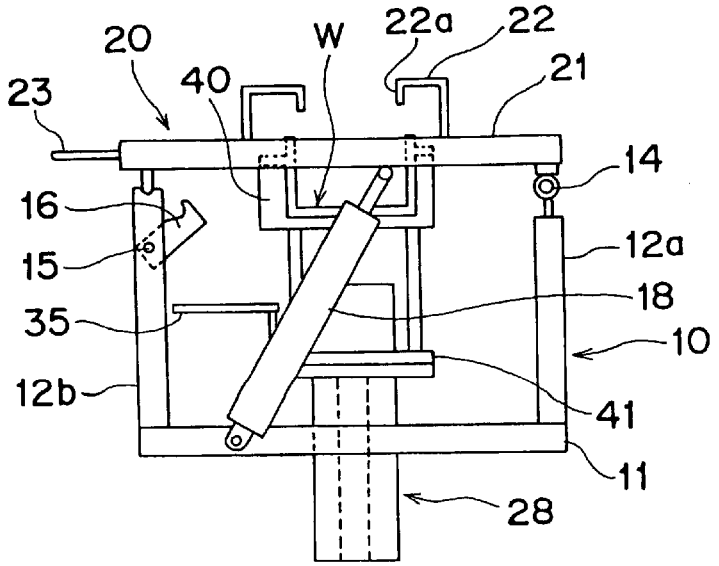
FIG. 4 is a diagram of the same entire apparatus in which the mask supporting frame is in a closed state.
Figure 5:
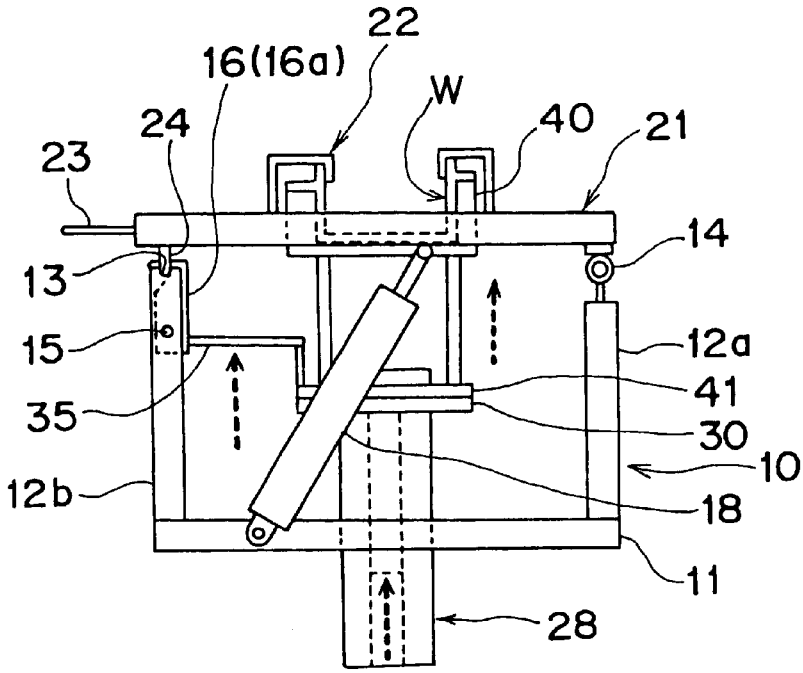
FIG. 5 is a diagram of the same entire apparatus showing the receiving jig raised and the work covered by the mask main body.
Figure 6:
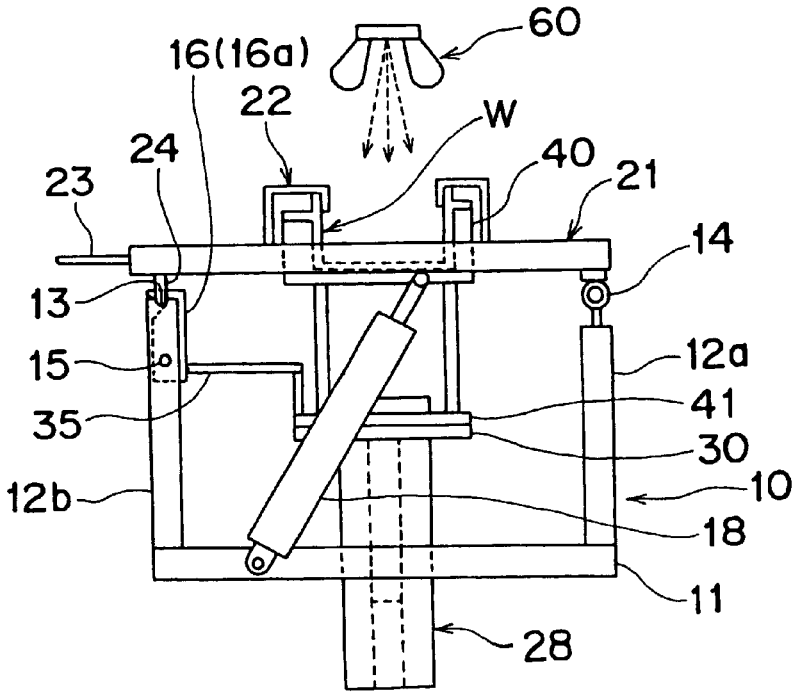
FIG. 6 is a diagram of the same entire apparatus during painting.
Figure 7:
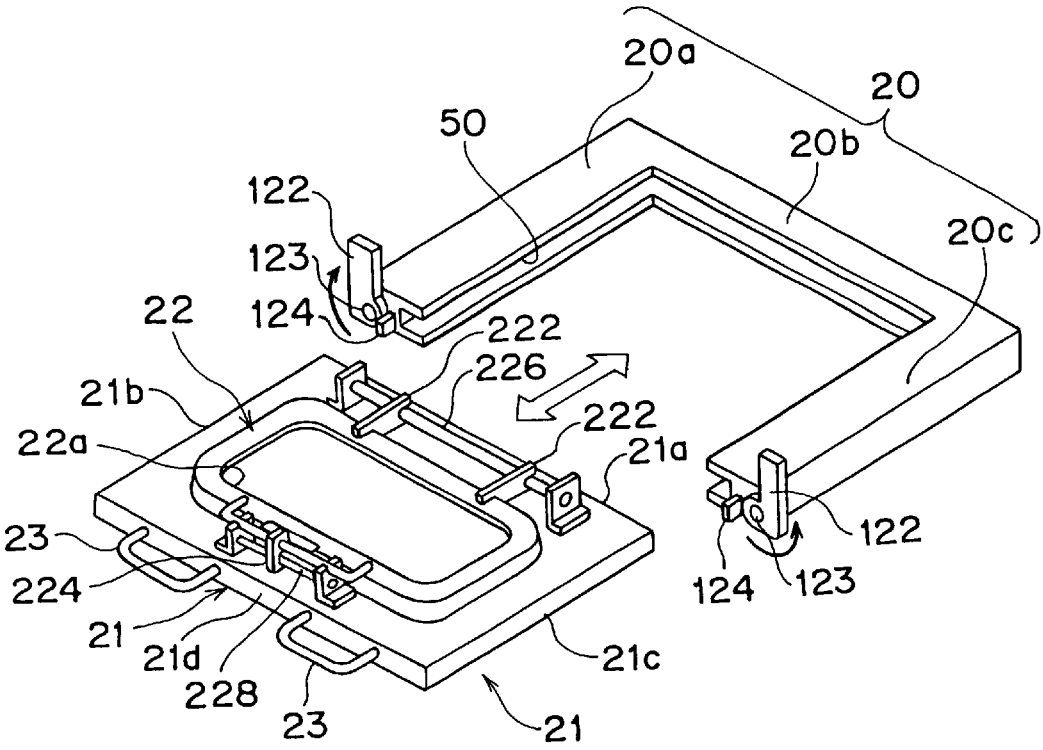
FIG. 7 is a perspective view showing the mask body sliding and attaching to/detaching from the mask supporting frame.
Figure 8:
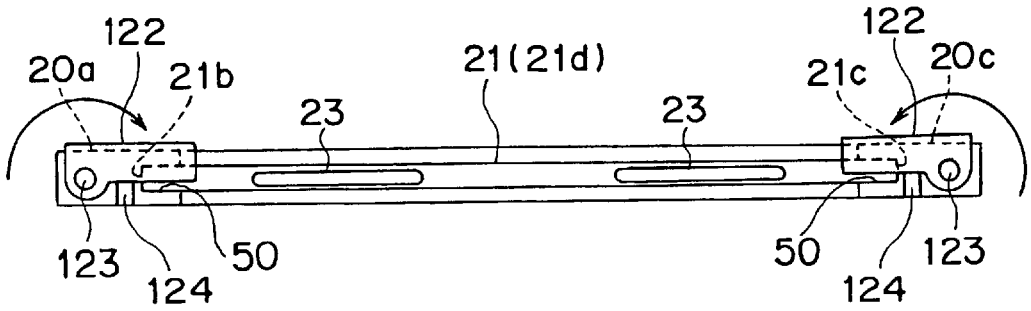
FIG. 8 is a front view showing the manner in which the mask body is securely fixed.
Figure 9:
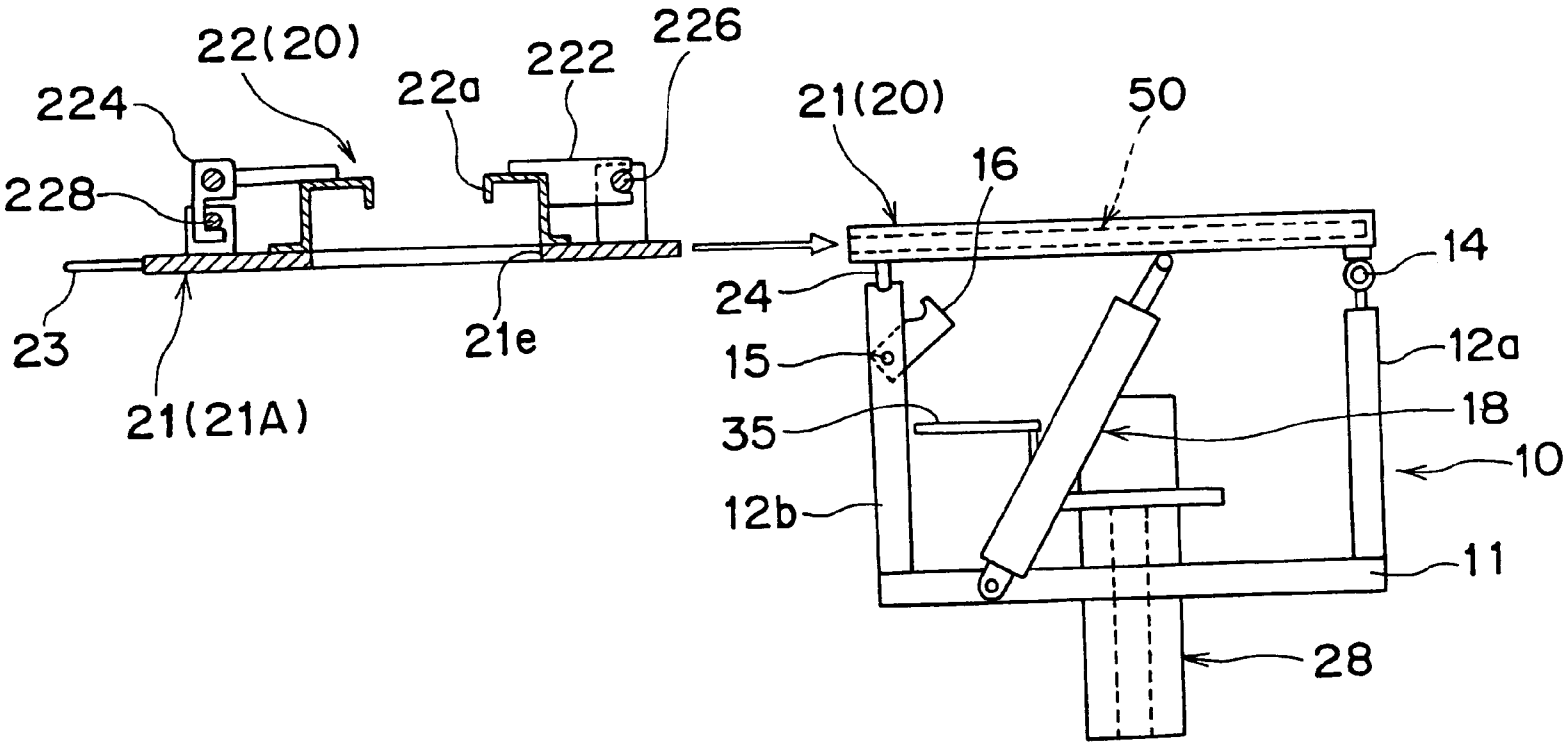
FIG. 9 is a diagram of the same entire apparatus showing the mask body slide-engaging with the mask supporting frame.
Figure 10:
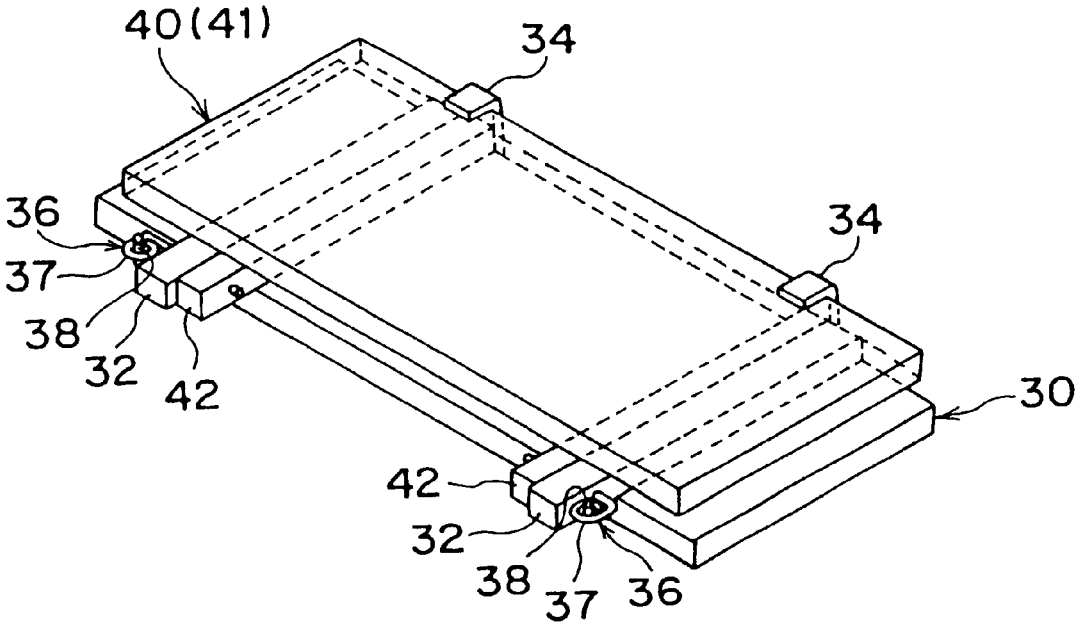
FIG. 10 is a perspective view of the mask body integrally assembled with the mask supporting frame.
Figure 11:
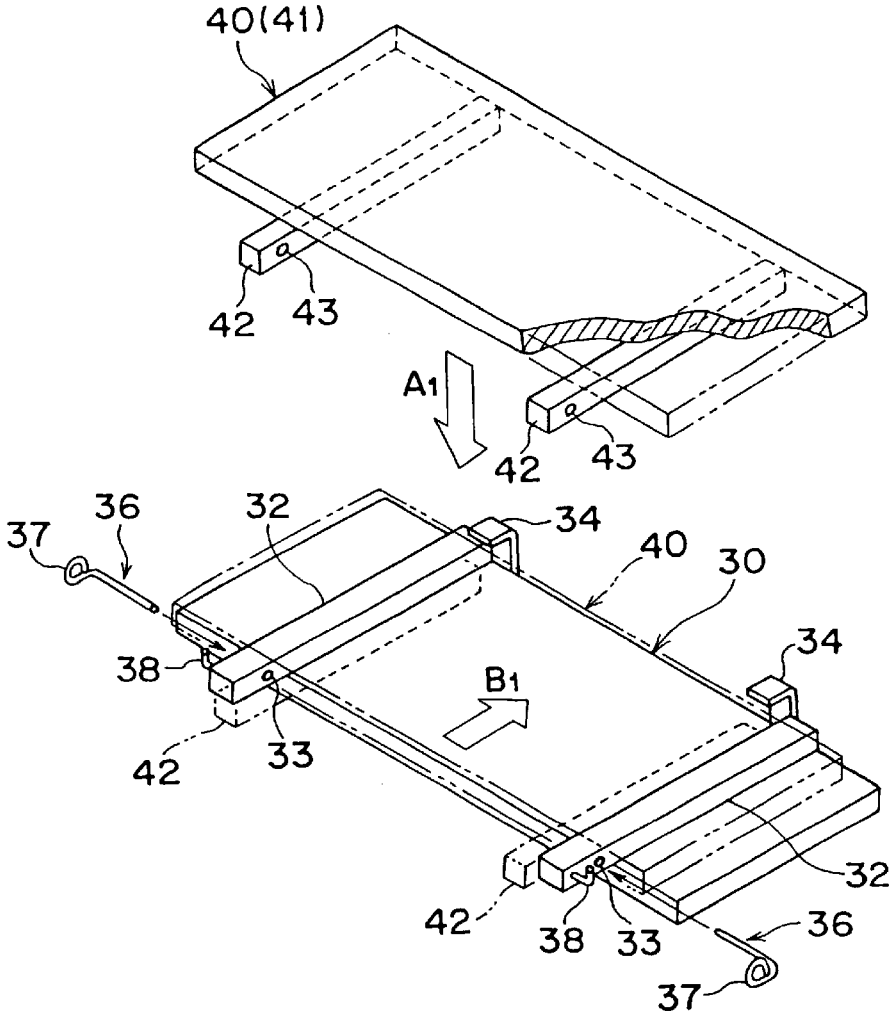
FIG. 11 is an exploded perspective view of the dovetail groove slide-engaging portion between the mask body and the mask supporting frame.
Figure 12:
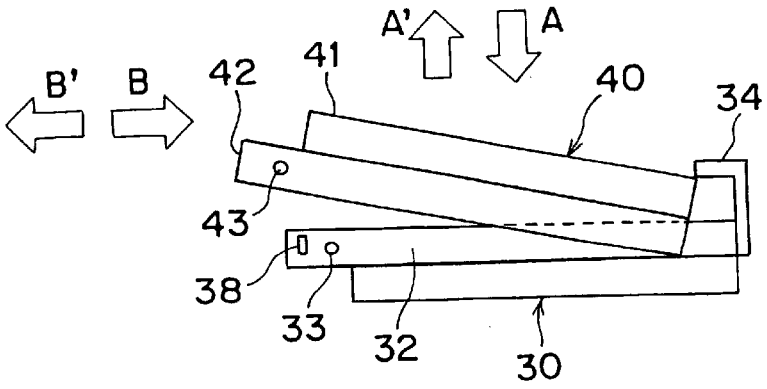
FIG. 12 is an explanatory view showing the receiving jig slide-engaging with the jig base.
Figure 13:
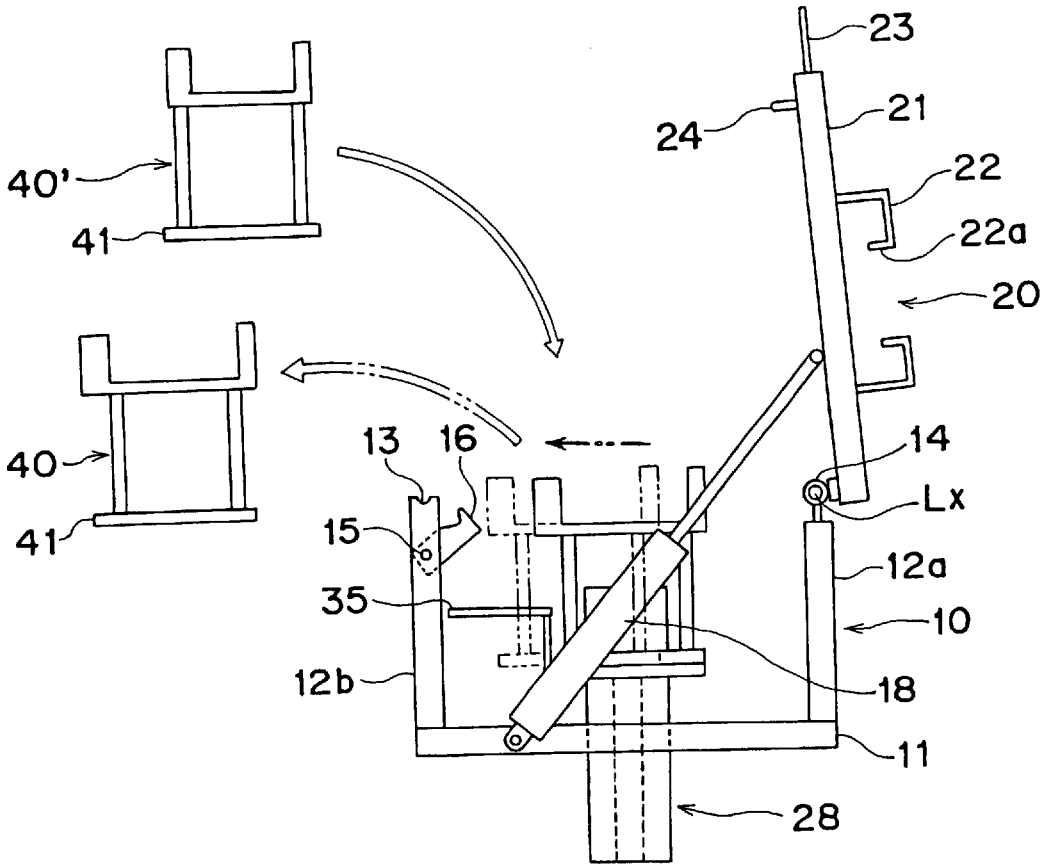
FIG. 13 is a diagram of the same apparatus showing the receiving jig being removed from the jig base and a new receiving jig being attached to the jig base.

FIGS. 1 through 13 show a preferred embodiment of the paint mask apparatus according to the present invention. FIG. 1 is a block diagram of the overall paint mask apparatus of the first embodiment, FIG. 2 is a block diagram of the same entire apparatus in which the area above the receiving jig is open, FIG. 3 is a block diagram of the same entire apparatus showing the work as it is set into the receiving jig, FIG. 4 is a block diagram of the same apparatus with the mask supporting frame in a closed state, FIG. 5 is a block diagram of the same apparatus showing the receiving jig raised and the work covered by the mask main body, FIG. 6 is a block diagram of the same apparatus during painting, FIG. 7 is a perspective view showing the mask body sliding and attaching to/detached from the mask supporting frame, FIG. 8 is a front view illustrating the fixing of the mask body, FIG. 9 is a block diagram of the same apparatus showing the mask body slide-engaging with the mask supporting frame, FIG. 10 is a perspective view in which the mask body has been integrally assembled with the mask supporting frame, FIG. 11 is an exploded perspective view of the dovetail groove slide-engaging portion between the mask body and the mask supporting frame, FIG. 12 is a schematic diagram illustrating the receiving jig slide-engaging with the jig base, FIG. 13 is a block diagram of the same apparatus showing the receiving jig being removed from the jig base and a new receiving jig being attached to the jig base.

In these figures, reference numeral 40 denotes a receiving jig upon which a work W, which is a molded part of composite resin and which forms a component part of a lamp for a vehicle, is mounted. This receiving jig 40 is integrally fixed to a jig base 30 capable of being raised and lowered by means of an air cylinder mechanism 28 mounted on an outer base 10.

A mask supporting frame 20 with an integrated mask main body 22 of a shape corresponding to the molded part W is provided on the outer base 10 so as to be able to swing up and down. An opening 22*a* corresponding to the area to be painted of the work W is formed in the mask main body 22, as shown in FIGS. 1 and 7. As shown in FIG. 1, the mask supporting frame 20 (mask main body 22) is closed and the mask main body 22 is positioned directly above the receiving jig 40 (molded part W). Then, as shown in FIGS. 5 and 6, the jig base 30 is raised by means of the air cylinder mechanism 28 such that all but the area to be painted of the work W is covered by the mask main body 22. The work W (the area to be painted thereof) is then spray-painted from above the mask main body 22. Accordingly, it is possible to apply paint to only a predetermined area (the area to be painted) of the molded part W.

On the outer base 10, braces 12*a*, 12*b* are provided standing upright at the four corners of the front and rear ends of the frame body 11 which is rectangular when viewed from above. A bearing 14 which supports the mask supporting frame 20 with the integrated mask main body 22 so as to enable it to swing up and down is provided on the upper end portions of the left and right pair of braces 12*a*, 12*a* on the rear end side of the apparatus. The rear end portion of the mask supporting frame is supported by the bearing 14, forming a horizontal axis Lx. As shown in FIG. 2, the mask supporting frame 20 can swing up and down around this horizontal axis Lx such that the mask supporting frame 20 (mask main body 22) can close, with the mask main body 22 positioned directly above the receiving jig 40 (molded part W) (see FIG. 1), and spring up, opening above the receiving jig 40 (molded part W).

Moreover, a latch 24 extending in a U-shape as seen from the front is provided on the front end side (left side of FIG. 1) of the mask supporting frame 20. This latch 24 engages with U-shaped grooves 13 formed in the upper ends of the pair of left and right braces 12*b* on the front end side. By securing the latch 24 with a hook 16 provided on the braces 12*b*, the latch 24 is maintained in an engaged state with the U-shaped grooves 13, that is, the mask supporting frame 20 (mask main body 22) is maintained in a closed state.

The securing of the latch 24 by rotating the hook 16 is done by raising the jig base 30. That is, an extended portion 35 that extends horizontally to the front is provided on the jig base 30 such that, as shown in FIG. 5, when the jig base 30 is raised by the operation of the air cylinder mechanism 28, the extended portion 35 hits the outside surface 16*a* of the hook 16, rotating it around its pivotal point 15 so as to secure the latch 24. The secured hook 16 can be easily released by rotating a lever (not shown).

The mask supporting frame 20 is of a size that matches the outer base 10 and is formed from a frame body that is U-shaped which opens to the front when viewed from above, as shown in FIG. 7. A dovetail groove 50 which continues in the direction in which the frame portion extends is provided on the inside of each frame portion 20*a*, 20*b*, and 20*c*.

The mask body 21 is formed of a rectangular metal plate 21A in which is formed an opening 21*e* (see FIG. 9) of a size matching the exterior of the work W, and a mask main body 22 integrally attached to this metal plate 21A. The mask main body 22 is integrally fixed to the metal plate 21A so as to cover the opening 21*e*. Reference numeral 222 denotes an engaging arm on the side of the mask main body 22, and reference numeral 224 denotes a latch hook. The mask main body 22 is integrally fixed to the metal plate 21A so as to cover the opening 21*e*. Reference numeral 222 denotes an engaging arm on the side of the mask main body 22, and reference numeral 224 indicates a latch hook. The mask body 21, in which the mask main body 22 is integrated with the metal plate 21A, is formed by engaging the engaging arm 222 with a horizontal rod 226 on the side of the metal plate 21A and securing the latch hook 224 to a latch 228 on the side of the metal plate 21A.

The metal plate 21A is of a size that enables three side edge portions 21*a*, 21*b*, and 21*c* to slide-engage with the dovetail groove 50 in the mask supporting frame 20. As shown by the arrow in FIG. 7, the mask body 21 (metal plate 21A) can be integrated with as well as separated from the mask supporting frame 20 by sliding it forward and backward from a position in front of the mask supporting frame 20. Reference numeral 23 denotes a handle provided on the metal plate 21A.

An L-shaped lock lever 122 that secures the mask body 21 slide-engaged with the mask supporting frame 20 is provided on the ends of frame portions 20*b*, 20*c* which form the mask supporting frame 20. The lock lever 122 rotates around a axis 123, as shown in FIG. 8, and abuts against a stopper 124 protruding from the frame portions 20*b*, 20*c* so as to abut against the side edge portion 20*d* of the mask body 21, thereby preventing the mask body 21 from falling out. The lock of the mask body 21 can easily be released by an operator rotating the lock lever 122 by hand.

Reference numeral 18 denotes a pair of left and right air cylinders disposed between the base 11 of the outer base 10 and the side edge portions of the mask supporting frame 20. The cylinders 18, which are arranged near the front end of the base 11 and substantially in the center in the front/back direction of the mask supporting frame 20, operate to swing the mask supporting frame 20 open and closed. The air cylinders 18 are disposed so as to be inclined at the angle of about 45°. The extension force of the extension rods is very efficiently converted into rotational force of the mask supporting frame 20.

A pair of left and right guide rails 32 which extend in the front/back direction (the left/right direction in FIG. 1) of the apparatus main body, as shown in FIGS. 10 and 11, are provided on the rectangular jig base 30. Guides 42 which correspond to the guide rails 32 on the jig base 30 side are provided on the bottom surface of a base plate 41 on the receiving jig 40 side formed in a rectangular shape which corresponds to the jig base 30. Both the guide rails 32 on the jig base 30 side and the guides 42 on the receiving jig 40 side are formed with identical rectangular cross sections, with the guides 42 formed so as to slidably engage both vertically and longitudinally on the inside of the guide rail 32.

Reference numeral 34 denotes an L-shaped stopper for positioning the receiving jig formed on a rear end portion of the guide rail 32. Reference numeral 36 indicates a lockpin for fixing the position of the receiving jig. Pin holes 33, 43 are provided in the guide rail 32 and the guide 42, such that by inserting the lock pin 36 into the pin holes 33, 43 while the guide 42 is in a slide-engaged state with the guide rail 32 and securing the hole of the lock pin ear 37 around the latch 38 protruding from the guide rail 32, the (base plate 41 of the) receiving jig 40 is maintained in a position fixed to the jig base 30.

That is, when attaching the receiving jig 40 to the jig base 30, when the guide 42 on the receiving jig 40 side is engaged on the inside of the guide rail 32 on the jig base 30 side from above (as indicated by the broken lines in FIG. 11), as shown by arrow A in FIG. 12 (arrow $A_1$ in FIG. 11), and the (guide 42 of the) receiving jig 40 is pushed in along the (guide rail 32 of the) jig base 30, as shown by arrow B in FIG. 12 (arrow $B_1$ in FIG. 11), the base plate 41 and the guide 42 on the receiving jig 40 side are retained by the L-shaped stopper 34 such that the pin holes 43, 33 line up. The receiving jig 40 is then fixed in position to the jig base 30 using the lock pin 36.

Conversely, when removing the receiving jig 40 from the jig base 30, sliding the receiving jig 40 to the front along the guide rail 32, as shown by an arrow B' in FIG. 12, so that it is no longer retained by the L-shaped stopper 34 and lifting the entire body of the receiving jig 40 up, as shown by arrow A' in FIG. 12, separates it from the (guide rail 32 of the) jig base 30.

Next, the painting process in which paint is applied to the work W using the apparatus of the present embodiment will be described.

First, the mask supporting frame 20 is raised so as to be in a state in which the area above the receiving jig 40 is open, and the work W is set into the receiving jig 40, as shown in FIG. 3. Next, the mask supporting frame 20 is closed by the air cylinder mechanism 33, as shown in FIG. 4. Then, the jig base 30 (the receiving jig 40 and the work W) is raised by the air cylinder 18 so that the work W is covered by the mask main body 22 and only the area to be painted is open above, as shown in FIG. 5. At this time, the hook 16 is rotated by the raising of the jig base 30 so as to secure the latch 24 on the mask supporting frame 20 side so that the mask supporting frame 20 is maintained fixed to the outer base 10. Then, paint is applied to the area of the work W to be painted using a spray gun 60, as shown in FIG. 6.

Subsequently, the jig base 30 (the receiving jig 40 and the work W) is lowered by the air cylinder mechanism 28 and the work W is separated from the mask main body 22. Then, the mask supporting frame 20 is raised by the air cylinder 18 so as to be in a state in which the area above the receiving jig 40 (the work W) is open. The mask is removed and a new mask is set into the receiving jig 40. Painting is then performed in the aforementioned sequential routine.

Next, a case will be described in which the apparatus of the present embodiment is used for painting a work of a different shape.

A mask body 21' (not shown), which corresponds to a new work W' of a different shape (not shown), and a receiving jig 40' (see FIG. 13) are prepared in advance. The mask body 21' is of a construction identical to that of the mask body 21, except that the opening 21*e* provided in the metal plate 21A which forms the mask body 21 and the mask main body 22 which is attached so as to cover this opening 21*e* are formed in a shape which corresponds with the new work W'.

The receiving jig 40' is also of a construction identical to that of the receiving jig 40, except that it is of a predetermined shape that enables the new work W' of a different shape to be mounted. That is, the mask body 21' is constructed so as to be able to slide-engage with the dovetail groove 50 in the mask supporting frame 20, and the receiving jig 40' is constructed so as to be able to slide-engage with the guide rail 32 on the jig base 30.

With the mask supporting frame 20 raised so that the area above the receiving jig 40 is in an open state, the receiving jig 40 is slid forward with respect to the jig base 30, as shown by broken lines in FIG. 13, so that the base plate 41 on the receiving jig 40 side is no longer retained by the L-shaped stopper 34. The receiving jig 40 is then lifted upward and removed. Then, another receiving jig 40' is engaged with the jig base 30 from above so that the guide 42 fits inside the guide rail 32. Next, the receiving jig 40 is pushed in along the guide rail 32 so that the base plate 41 is retained by the U-shaped stopper 34, thereby mounting the receiving jig 40 on the jig base 30. With the mask supporting frame 20 in a closed state, the mask body 21 is slid against the mask supporting frame 20 and removed, and another mask body 21' is slid against the mask supporting frame 20 and mounted. Then, the area to be painted of the work W' of a different shape is painted according to the same procedures of the painting process for the aforementioned work W.

Figure 14:
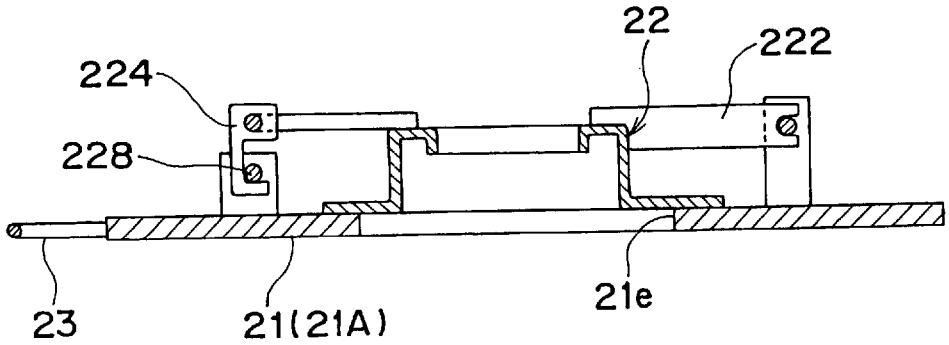
FIG. 14 is a cross-sectional view of the mask body, which is a crucial part of the paint mask apparatus of another embodiment of the present invention.
Figure 15:
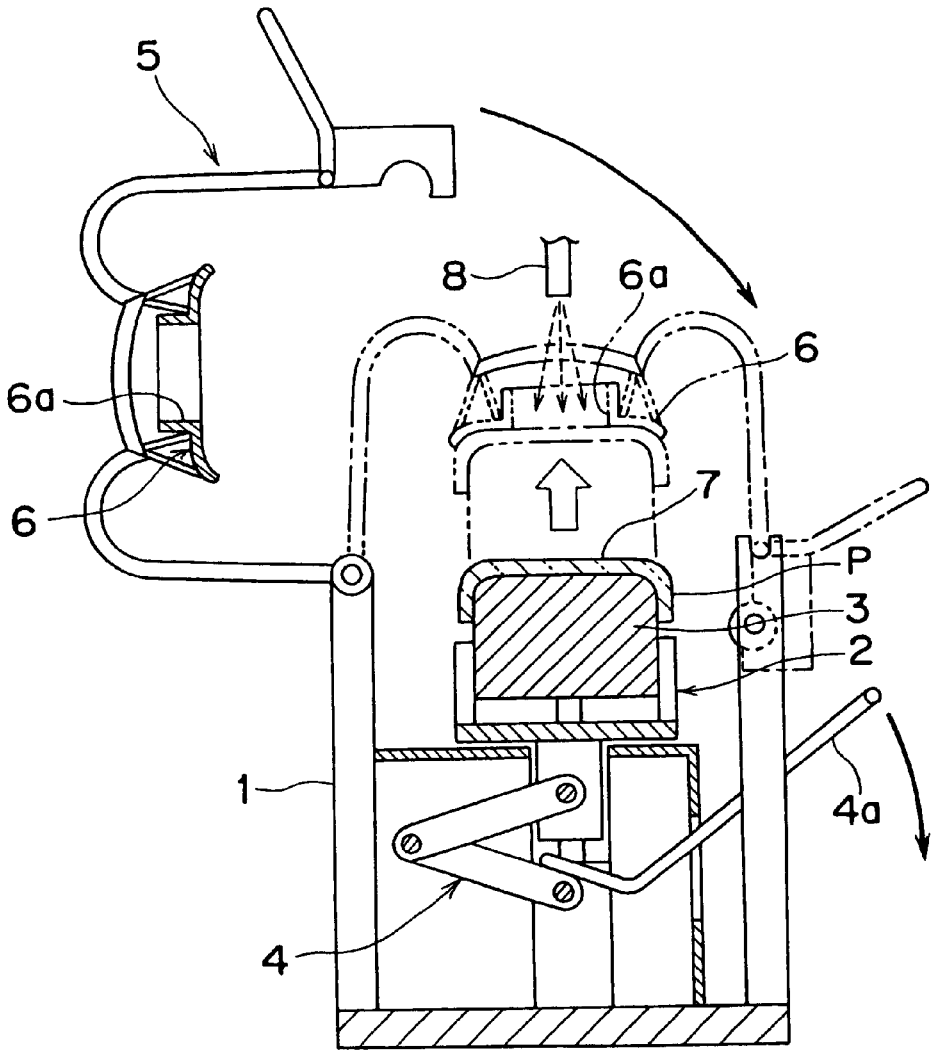
FIG. 15 PRIOR ART
FIG. 15 is a longitudinal sectional view of a conventional paint mask apparatus with the mask portion open.

The foregoing embodiment relates a construction in which the entire body of the mask body 21 is replaced. However, as shown in FIG. 14, the invention may also be practiced with a construction in which the entire body of the mask body 21 does not need to be replaced, which is achieved by forming the opening 21*e* in the metal plate 21A so as to be slightly larger than the exterior of the work W and replacing only the mask main body 22 on the metal plate 21A.

Also, in the foregoing embodiment, an air cylinder mechanism is used to both raise and lower the jig base 30 and open and close the mask supporting frame 20. Alternatively, a hydraulic cylinder may be used.

As made clear by the above description, with the paint mask apparatus according to the present invention, even if the type of part to be painted is different, that part can easily be accommodated by replacing only the mask body and the receiving jig.

In particular, the replacement operation of the mask body and receiving jig when the paint mask apparatus is incorporated into a production line is simple and can be done in a short period of time.

Also, the space needed to store the removed mask body and receiving jig can be minimized.

According to the invention, removal and attachment of the mask body and the receiving jig is easy and the replacement operation of the mask body and the receiving jig so as to accommodate different works can be done rapidly.

Moreover, the swinging (opening and closing) of the mask supporting frame and the raising and lowering of the jig base that an operator conventionally did by hand are done by operation of a cylinder mechanism. Therefore, the amount of labor required by the operator is reduced by an equivalent amount and the painting process becomes smoother.

The mask body and the receiving jig can easily be attached and detached from the front surface side of the apparatus main body. Therefore, even if the type of part to be painted is different, it can be accommodated extremely easy by replacing only the mask body and the receiving jig.

With the invention, even if the type of part to be painted is different, it can easily be accommodated by replacing the mask main body and the receiving jig when all that is required is that the mask body and the receiving jig be replaced.

In particular, the replacement operation of the mask body and receiving jig when the paint mask apparatus is incorporated into a production line is simple and can be done in a short period of time. Also, the space needed to store the removed mask body and receiving jig is reduced.

It should further be apparent to those skilled in the art that various changes in form and detail of the invention as shown and described above may be made. It is intended that such changes be included within the spirit and scope of the claims appended hereto.

What is claimed is:

1. A paint mask apparatus comprising: a jig base provided in an outer base; a receiving jig for mounting a part to be painted, said receiving jig being supported by said jig base provided in said outer base; a mask body of a predetermined shape covering at least a peripheral edge portion of an area to be painted of said part to be painted; and a mask supporting frame receiving said mask body, said mask supporting frame being attached to said outer base so as to be swingable up and down such that the mask body can selectively cover and uncover said receiving jig from above, said mask body being detachably mounted on said mask supporting frame, and said receiving jig being detachably mounted on said jig base.

2. The paint mask apparatus according to claim 1, wherein said mask supporting frame comprises a detachable portion for receiving said mask body, said detachable portion of said mask supporting frame being formed by a dovetail groove slide-engaging portion extending along an extended surface of said mask supporting frame, and said jig base comprises a detachable portion for receiving said receiving jig, said detachable portion of said jig base being formed by a slide-engaging portion extending along an upper surface of said jig base.

3. The paint mask apparatus according to claim 2, wherein said dovetail groove slide-engaging portion between said mask body and said mask supporting frame extends to an end side of said mask supporting frame from a swinging tip side of said mask supporting frame, said slide-engaging portion between said receiving jig and said jig base extends in a front/rear direction of said jig base, and further comprising a pair of jointly operated fluid cylinder mechanisms for swingably opening and closing said mask supporting frame, said fluid cylinder mechanisms being provided opposing one another on respective left and right side edge portions of said mask supporting frame.

4. The paint mask apparatus according to claim 3, further comprising a lock lever pivotally mounted on said mask body for locking said mask main body to said mask body.

5. The paint mask apparatus according to claim 1, further comprising a first fluid cylinder mechanism for swinging said mask supporting frame around a horizontal axis for opening and closing said mask supporting frame, said fluid cylinder mechanism being disposed between said mask supporting frame and said outer base, and further comprising a second fluid cylinder mechanism for raising and lowering vertically said jig base, said second fluid cylinder mechanism being disposed between said jig base and said outer base.

6. The paint mask apparatus according to claim 1, further comprising a mask main body of a predetermined shape which covers the peripheral edge portion of an area to be painted of said part to be painted, said mask main body being removably attached to said mask body.

7. The paint mask apparatus according to claim 1, wherein said outer base comprises a rectangularly shaped frame body and at least four braces standing upright at the four corners at front and rear sides of said frame body.

8. The paint mask apparatus according to claim 7, further comprising a lock lever pivotally mounted on one of said braces and a latch mounted on a swinging end of said mask body at a position adjacent said lock lever for selectively locking said mask main body to said mask body.

9. The paint mask apparatus according to claim 1, further comprising an air cylinder mechanism for raising and lowering said jig base with respect to said outer base.

10. The paint mask apparatus according to claim 1, wherein said jig base comprises a pair of guide rails extending in a front/rear direction, and said receiving jig comprises a base plate and a pair of guides mounted on said base plate at positions so as to slidably engage respective ones of said guide rails.

* * * * *